US010011422B2

(12) United States Patent
Marchesini

(10) Patent No.: US 10,011,422 B2
(45) Date of Patent: Jul. 3, 2018

(54) AERATION APPARATUS FOR TANKS CONTAINING POWDERED MATERIALS OR THE LIKE

(71) Applicant: OLI S.P.A., Medolla, Modena (IT)

(72) Inventor: Vainer Marchesini, San Prospero (IT)

(73) Assignee: OLI S.P.A., Medolla (Modena) (IT)

( * ) Notice: Subject to any disclaimer, the term of this patent is extended or adjusted under 35 U.S.C. 154(b) by 69 days.

(21) Appl. No.: 15/027,310

(22) PCT Filed: Oct. 8, 2014

(86) PCT No.: PCT/IB2014/065154
§ 371 (c)(1),
(2) Date: Apr. 5, 2016

(87) PCT Pub. No.: WO2015/052666
PCT Pub. Date: Apr. 16, 2015

(65) Prior Publication Data

US 2016/0244254 A1 Aug. 25, 2016

(30) Foreign Application Priority Data

Oct. 8, 2013 (IT) ..... BO13A0552

(51) Int. Cl.
*B65D 88/64* (2006.01)
*B65D 88/66* (2006.01)
*B65D 88/70* (2006.01)

(52) U.S. Cl.
CPC ..... *B65D 88/66* (2013.01); *B65D 88/665* (2013.01); *B65D 88/706* (2013.01)

(58) Field of Classification Search
CPC ..... B65D 88/64; B65D 88/548; B65D 88/54; B65D 88/58; B65D 88/66; B65D 88/70;
(Continued)

(56) References Cited

U.S. PATENT DOCUMENTS 3,343,888 A * 9/1967 Anderson ..... B65D 88/706 406/138
3,637,115 A * 1/1972 Holm ..... B65D 88/665 222/195

(Continued)

FOREIGN PATENT DOCUMENTS

CN 2392643 Y * 8/2000
CN 2707685 Y 7/2005

(Continued)

OTHER PUBLICATIONS

PCT, International Search Report and Written Opinion, International Application No. PCT/IB2014/065154, dated Apr. 21, 2015.

(Continued)

*Primary Examiner* — Patrick M Buechner
(74) *Attorney, Agent, or Firm* — FisherBroyles, LLP; Susan M. Oiler

(57) ABSTRACT

An aeration apparatus to ease the emptying of a mass of powdered material from any kind of container. The apparatus comprises a vibrating membrane coupled to a device for pulling and fastening it to the container wall, so that said membrane adheres to the inner surface of the container wall. The apparatus is characterized in that the inner surface of membrane has a number of grooves shaped as radial recesses formed only on the lower half of the inner surface of the membrane itself. Each radial section of any radial recess is advantageously venturi-shaped.

10 Claims, 10 Drawing Sheets

(58) Field of Classification Search
CPC ..... B65D 88/703; B65D 88/72; B65D 88/74; B65D 88/748; B65D 88/665; B65D 88/706
USPC ..... 222/195
See application file for complete search history.

(56) References Cited

U.S. PATENT DOCUMENTS 3,754,740 A * 8/1973 Piper ..... B01F 3/04255 239/533.13
3,929,261 A * 12/1975 Solimar ..... B65D 88/706 222/195
3,952,956 A * 4/1976 Steele ..... B08B 5/02 134/167 R
4,030,755 A * 6/1977 Heimke ..... B01J 8/44 222/195
4,172,539 A * 10/1979 Botkin ..... B65D 88/706 222/195
4,556,173 A * 12/1985 Pausch ..... B65D 88/706 137/860
4,662,543 A 5/1987 Solimar
4,820,052 A * 4/1989 Krysel ..... B01F 13/0283 137/860
5,017,053 A * 5/1991 Sisk ..... B01F 13/0255 366/101
5,129,553 A * 7/1992 Becker ..... B65D 88/706 137/854
5,139,175 A * 8/1992 Krysel ..... B65D 88/706 137/860
5,381,606 A * 1/1995 Solimar ..... B65D 88/706 34/582
5,988,867 A * 11/1999 Sisk ..... B65G 53/16 222/195
6,007,234 A * 12/1999 Steele ..... B65D 88/706 239/533.14
8,449,170 B1 * 5/2013 Jarvela ..... B65G 53/42 222/195
2009/0145514 A1 * 6/2009 Sisk ..... B65G 53/22 141/67

FOREIGN PATENT DOCUMENTS

CN 202859574 U * 4/2013
CN 204250682 U 4/2015
GB 994634 6/1965
GB 1027680 A 4/1966
JP H10114429 * 5/1998
NL 7413837 A 4/1976
WO 03/037753 A1 5/2003

OTHER PUBLICATIONS

First Office Action issued in CN 201480055718.9, dated Mar. 29, 2017 (8 pages).
English Summary of the First Office Action issued in CN 201480055718.9 (5 pages).

* cited by examiner

SEZ.B-B

AERATION APPARATUS FOR TANKS CONTAINING POWDERED MATERIALS OR THE LIKE

RELATED APPLICATIONS

This application is a National Stage filing of International Application No. PCT/IB2014/065154, filed Oct. 8, 2014, which claims priority of Italian Application No. BO2013A000552, filed Oct. 8, 2013, which are incorporated herein by reference in their entireties.

TECHNICAL FIELD

The present invention relates to an aeration apparatus for tanks containing powdered materials or the like.

More precisely, the present invention relates to an aeration to ease the emptying of any powdered or granular material from any kind of tank.

In particular, the present invention is advantageously but non-exclusively applied in the tanks for trucks and silos, to which the following description will explicitly refer without losing in generality.

BACKGROUND ART

As is known, pneumatic conveying systems are used, for example, for discharging powdered or granular material from the tank of a truck.

These conveying systems include at least one tube, through which pressurized conveying air flows, which extends between the discharge port of the tank and the end user of the powdered or granular product.

It is also known that in order to ease the emptying of the tank, aeration apparatuses are used preferably placed at the bottom of the tank itself.

The truck tank usually ends at the bottom with a discharge hopper which is often shaped as an upturned truncated cone. At the end of the truncated cone there is said discharge port of the powdered material with possibly a discharge valve.

Aeration apparatuses are usually used to ease the discharge of the material, arranged in the discharge hopper upstream of the discharge valve.

As will be better seen hereafter, each aeration apparatus is provided with a membrane made to vibrate by the output of compressed air in the annular gap between the inner surface of the tank wall and the membrane itself.

As is known, the vibration of membranes with the air flow coming out of the aeration apparatuses are used to break up the mass of particles present at the bottom of the tank and considerably accelerate the output of powdered material from the discharge port.

The above vibro-fluidization technology can normally be used successfully with food or chemical powders (starch, plastic, sugar, coffee, feed, sand, cement, aggregates, fine grit, etc.), all materials which tend to become compacted once stored inside containers.

However, in the solutions adopted so far by all the manufacturers, the outlet of micro-jets into the hopper takes place in all directions.

In other words, the compressed air micro-jets are directed downwards, sideways but also upwards, without having a preferential outlet direction. It was experimentally found that especially the micro-jets facing upwards, rather than easing and favoring the discharge of powdered material from the port of the hopper, somehow slow down the discharge as they are substantially faced in a direction opposite to the natural one of descent by gravity.

Quite recently, in order to make the action of the micro-jets more effective, aeration apparatuses of the above type have been proposed with vibrating membranes provided with substantially helical grooves arranged both on the outer surfaces of the membranes themselves, and on the inner ones. The aim of the inventors of this solution clearly was to create vortices within the granular (or powdered) mass so as to ease the discharge of the material through the discharge port.

However, in the manufacturing practice, it was noted that the inconsistent turbulence which is created in the mass of material partly obstruct the fall by gravity of the material to the discharge port. Moreover, it was experimentally verified that the output turbulent flows from the above annular gap cause an acceleration of the membrane deterioration due to the increased friction of the material (often highly abrasive, such as fine sand) on the inner and outer surfaces of the membrane itself. Moreover, other problems of different nature have been found in aeration apparatuses used in truck tanks.

In fact, in the solutions adopted so far, the aeration systems are fixed to the hopper wall by means of screw systems which provide the use of a threaded rod which causes a pulling action on the membrane as it is tightened by an operator. However, the force modulus with which the membrane is pressed on the inner surface of the hopper wall plays an important part in the whole process. In fact, if the tie rod subjects the membrane to an insufficient pull, there will be too much clearance between the membrane and the wall and therefore the membrane will not be efficiently made to vibrate by the entrance of the compressed air into the tank.

In use on trucks, it was found that the vibrations to which the aeration apparatuses are subjected during the movements of the truck itself cause a loosening of the pull on the membranes which eventually leads to a malfunctioning of the whole system.

Disclosure of Invention

Therefore, the main object of the present invention is to provide an aeration apparatus which is free from the above drawbacks while being easy and cost-effective to be implemented.

Therefore, according to the present invention, an aeration apparatus is provided to reduce the discharge time for the emptying of a mass of powdered material from any kind of container. The aeration apparatus has a vibrating membrane coupled to a device for pulling and fastening it to a hopper wall of a container, so that the membrane adheres to an inner surface of the container. The membrane comprises at least an area of least resistance for an outlet air flow, so that the air comes out from the area of least resistance, and defines a plurality of grooves shaped as radial recesses in a portion of the inner surface of the membrane. The radial recesses are each oriented downwards toward a discharge port, thereby producing a strong preferential downward directionality of air micro jets exiting an annular gap between an inner surface of the hopper wall and an edge of the membrane.

The present invention relates to an aeration apparatus to ease the emptying of powdered material from any kind of container; apparatus comprising a vibrating membrane coupled to a system for fastening it to the container wall, so that said membrane adheres to the inner surface of the container wall; the apparatus is characterized in that said membrane has at least one area of least resistance for the outlet air flow, so that the air preferably comes out from said at least one area.

BRIEF DESCRIPTION OF THE DRAWINGS

Two preferred embodiments will now be described for a better understanding of the present invention by way of non-limiting examples only, with reference to the accompanying drawings, in which.

BEST MODE FOR CARRYING OUT THE INVENTION

Figure 1:
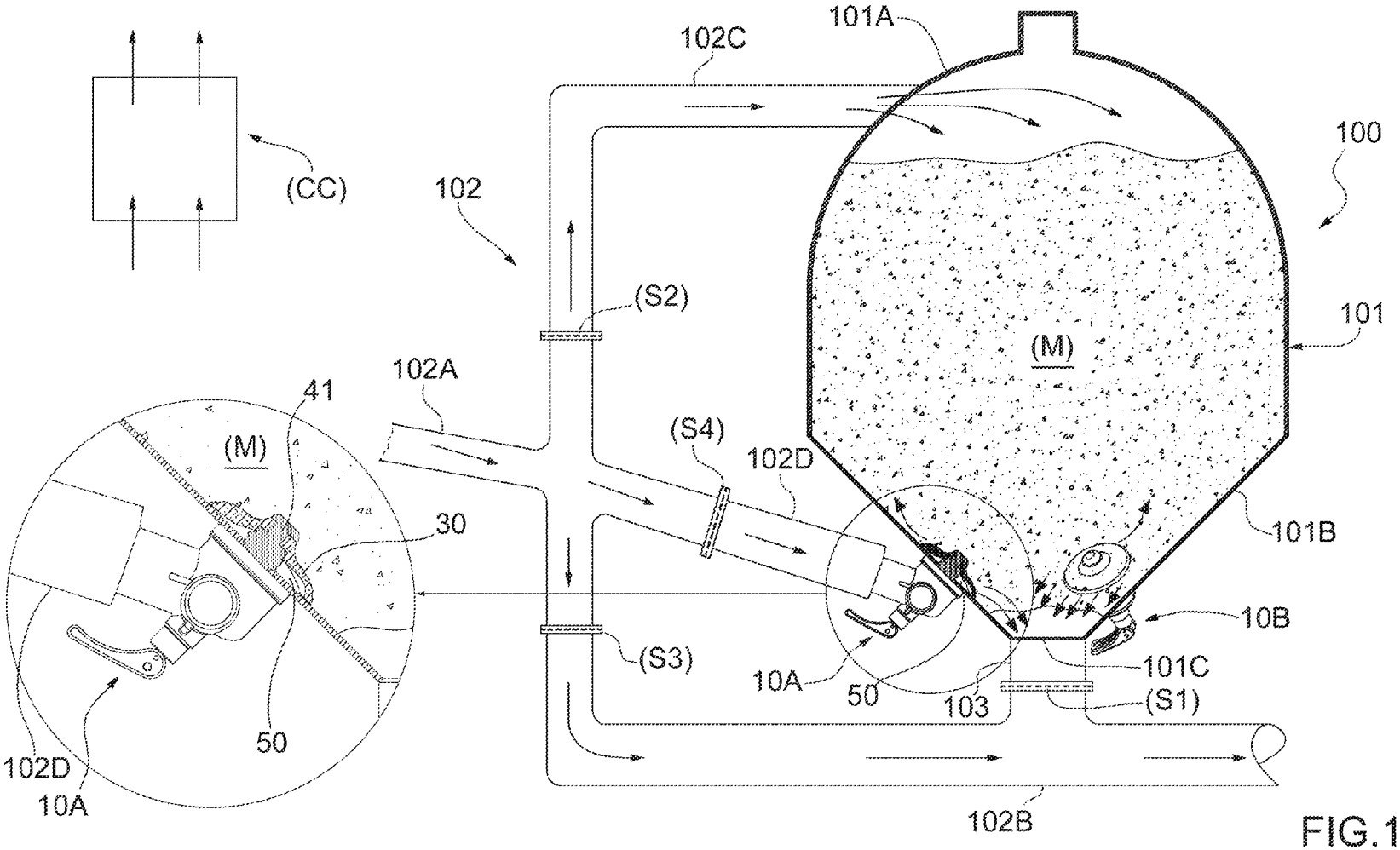
FIG. 1 shows a truck tank (with relative enlargement) for the storage of a powdered or granular material where at least one aeration apparatus manufactured according to the teachings of the present invention is integrated.

In FIG. 1, number reference 100 generally indicates, as a whole, a storage plant for a powdered or granular material.

Plant 100 comprises a tank 101, for example for trucks, wherein the mass (M) of powdered (or granular) material is stored and a distribution network 102 of compressed air.

Tank 101 comprises an upper cap-shaped portion 101A which overhangs a lower portion 101B shaped as a truncated-cone hopper. The lower portion 101B ends with a discharge port 101C of the product.

The distribution network 102 of compressed air, in turn, comprises a supply line 102A of compressed air (produced by a compressor, not shown), a main branch 102B for the pneumatic conveying of the material discharged from tank 101, a secondary branch 102C of supply of compressed air to the top of the cap, and a secondary branch 102D of supply of compressed air to the aeration apparatus 10A, 10B installed on the lower portion 101B of tank 101.

The main branch 102B connects tank 101 with an end user, for example with a concrete production plant (not shown) if the material transported by the truck is cement or sand.

Figure 2:
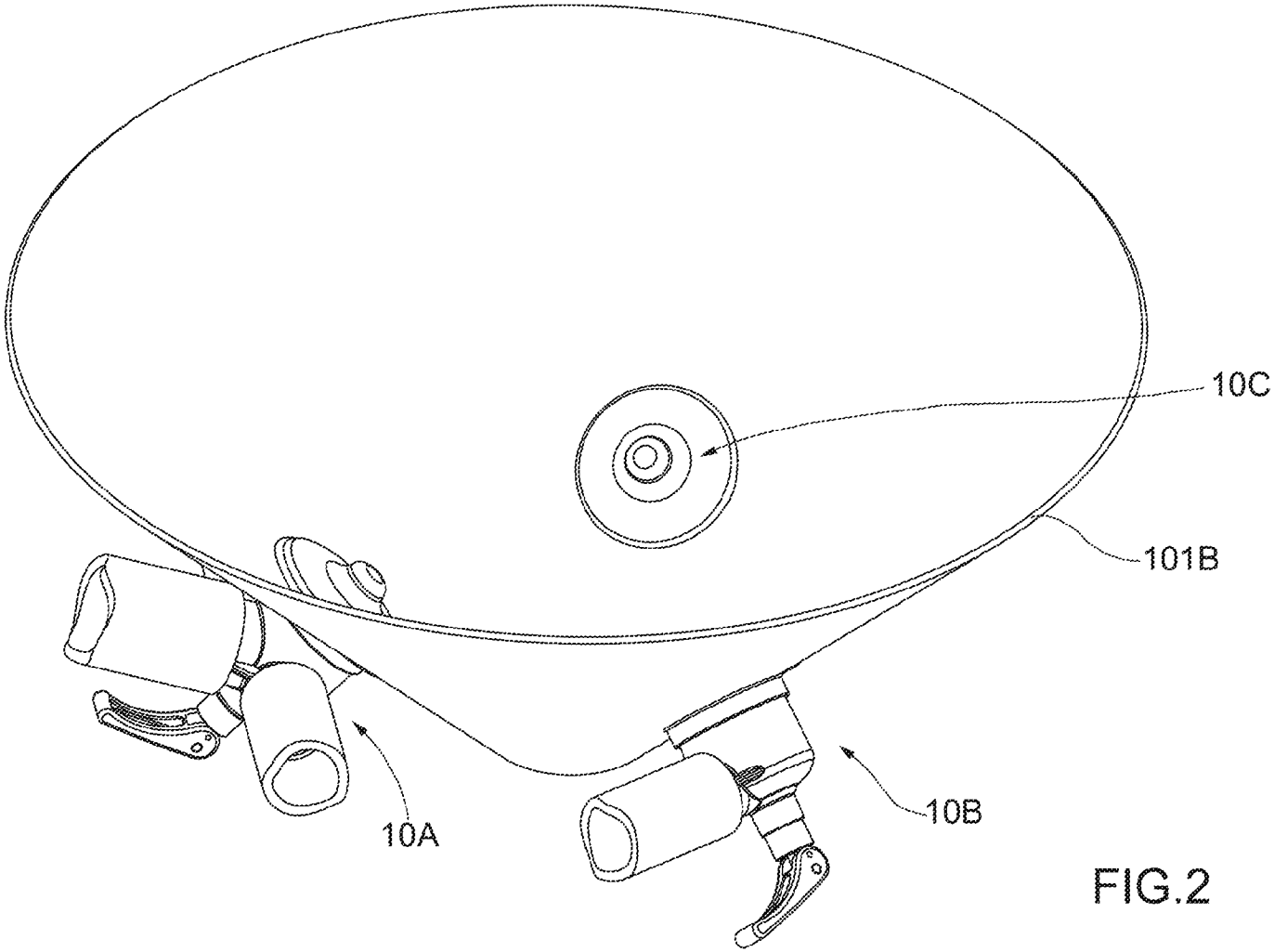
FIG. 2 shows a top view of the discharge hopper of the tank in FIG. 1 on which three aeration apparatuses manufactured according to the present invention are installed, by way of a non-limiting example.

Incidentally, it is noted that since in FIG. 1 tank 101 is shown in cross section, only two aeration apparatuses 10A, 10B are visible although there would actually be, for example, a third aeration apparatus 10C, equally-spaced from the other two and visible in FIG. 2. The number of aeration apparatuses will obviously vary according to the size of hopper 101B. In general, the larger hopper 101B, the higher the number of aeration apparatuses 10 mounted thereon.

As shown again in FIG. 1, between the exhaust port 101C and the main branch 102B a duct 103 is placed which is provided with a respective discharge valve (S1).

In actual use, when starting the operations for discharging tank 101, a control system (CC) (FIG. 1) managed by an operator controls the opening of the discharge valve (S1) and the operation of the distribution network 102.

A discharge valve (S2) related to the secondary branch 102C, a discharge valve (S3) coupled to the main branch 102B, and a discharge valve (S4) related to the secondary branch 102D will also open in sequence.

The mass (M) of granular (or powdered) material will fall by gravity from tank 101 to the main branch 102B flowing through duct 103 and through the corresponding open discharge valve (S1). The material, once arrived in the main branch 102B, is then conveyed by the pressurized air to the end user (not shown).

As affirmed above, to ease the discharge of tank 101, compressed air is then sent on the upper cap-shaped portion 101A of the tank 101 to put it under pressure, and to hopper 101B to feed the aeration apparatuses 10A, 10B, 10C (FIGS. 1, 2).

Since the three aeration apparatuses 10A, 10B, 10C are identical, describing a generic aeration apparatus 10 will suffice to describe all apparatuses.

In order to describe the first embodiment of the aeration apparatus 10, object of the present invention, reference will now be made, in particular, to FIGS. 3, 4, 5A and 5B.

The aeration apparatus 10 comprises a hollow main body 20 for supplying compressed air, a membrane 30 and a device for pulling and fastening said membrane 30 to a container wall, in this case to the hopper 101B wall of tank 101.

As will be seen, the pulling and fastening device 40 is given by the set of three elements 41, 42, 43 in the manner shown in particular in FIG. 4 (see below).

The hollow main body 20 comprises a cup-shaped element to which is coupled a supply fitting 22 of the compressed air coming from the distribution network 102 is coupled. The cup-shaped element 21 is provided with a substantial longitudinal symmetry axis (X); while the supply fitting 22 is provided with a longitudinal symmetry axis (Y), inclined by an angle ($\alpha$) relative to the axis (X). Angle ($\alpha$)) has a value advantageously between 20° and 40° chosen with the aim to reduce, as much as possible, the load losses which occur in the compressed air flow during its outflow into the hollow main body 20.

The cup-shaped element 21 is attached to two ducts 23, 24 which serve for the possible conveying of compressed air from one aeration apparatus 10A, 10B, 10C to the other (FIGS. 1, 2).

In other words, any aeration apparatus 10A, 10B, 10C can be supplied either directly by the distribution network 102 through the supply fitting 22, or it can be supplied indirectly by compressed air coming from an adjacent aeration apparatus 10A, 10B, 10C by means of one of the two ducts 23, 24. The cup-shaped element 21 can be made in different configurations according to the plant requirements.

The two ducts 23, 24 are aligned along an axis (Z) substantially perpendicular to a plane containing axes (X) and (Y).

In the cup-shaped element 21 (FIG. 5B) we may see a cup 20A with a circular open edge 20B and a bottom 20C opposite to said open edge 20B. A through hole 20D aligned with said axis (X) is located on bottom 20C.

On bottom 20C there is also a guide seat 20E in turn comprising a substantially curved lower portion surmounted by two flat lateral portions and an upper portion which is also flat (see below).

The pulling and fastening device 40 of membrane 30 comprises:

a pulling shaft 41; and a tie rod 42, at least partially threaded on a cylindrical front portion 42A, operated by a pulling element 43 (in this case a cam handle) resting on a bushing 44 sliding freely on a cylindrical back portion 42B of tie rod 42 along axis (X).

In particular, the pulling element 43 comprises a handle 43A ending with a cam 43B which, in use, rests on the sliding bushing 44.

Figure 3:
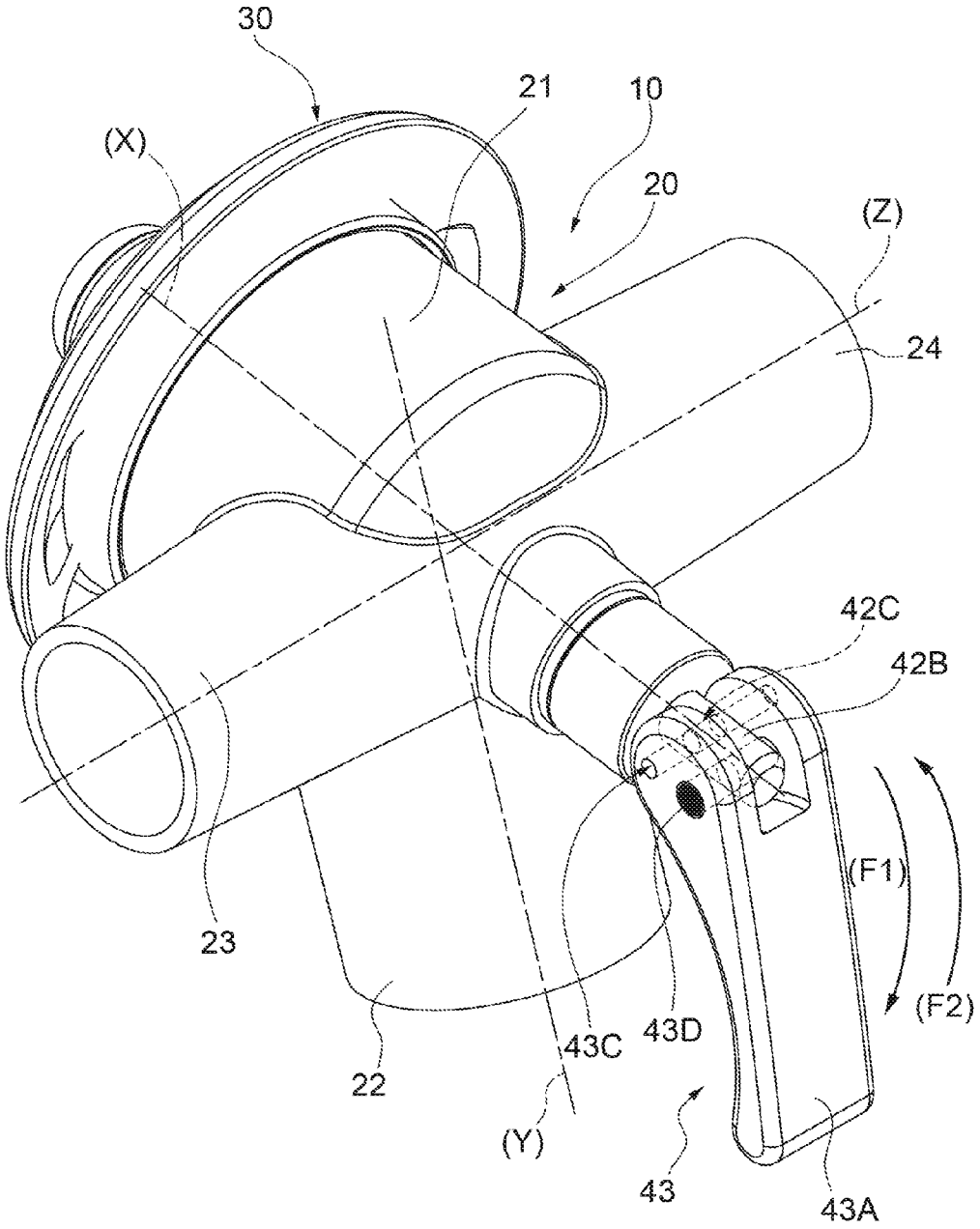
FIG. 3 shows a three-dimensional assembly of a first embodiment of an aeration apparatus according to the invention; such an aeration apparatus being one of those shown in FIGS. 1, 2.
Figure 4:
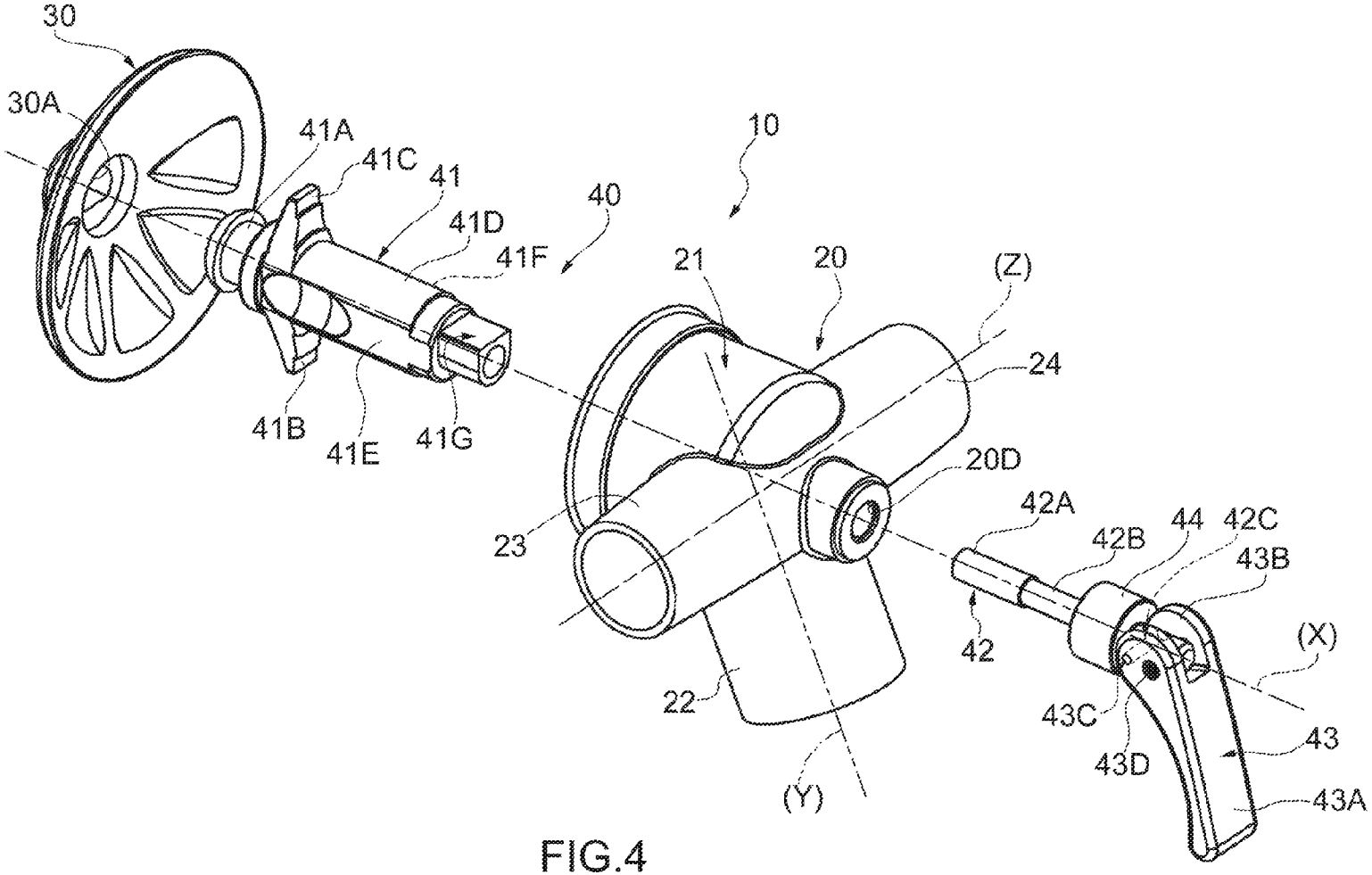
FIG. 4 shows an exploded view of the first embodiment shown in FIG. 3.

Moreover, as shown in FIGS. 3, 4, handle 43A is crossed by the cylindrical back portion 42B of tie rod 42. The pulling element 43 is further provided with a through hole 43C, while a through hole 42C (FIG. 3) is provided on the cylindrical back portion 42B of tie rod 42.

As will be better described hereinafter, when handle 43A is rotated clockwise according to an arrow (F1) about a fixed pin 43D which crosses both handle 43A and the cylindrical back portion 42B of tie rod 42, so that the pulling element 43 pulls membrane 30 resting on the inner surface of the hopper 110B wall (FIGS. 1, 2) (see below), the two through holes 43C, 42C are aligned (FIG. 3) and it is therefore possible to insert a split pin (not shown) into these through holes 43C, 42C to keep the pulling element 43 always in the same fixed position in spite of any vibration to which it may be subjected.

In other words, the split pin (not shown) inserted simultaneously in the two aligned through holes 43C, 42C is a sort of "safety lock" against possible vibrations and/or jumps (for example of the truck on which tank 101 is mounted), which could cause the accidental and hazardous counter-clockwise rotation of handle 43A about pin 43D according to an arrow (F2) opposite to said arrow (F1). Such a hypothetical rotation of handle 43A according to the arrow (F2) about pin 43D would cause the involuntary, and not desirable, loosening of the pulling action on membrane with a consequent increase of the annular gap formed between the outer perimeter of membrane 30 and the inner surface of the hopper 101B wall.

Locking by means of a split pin is just one of the countless ways to lock the cam. Alternative systems may also be used such as, for example, a snap lock of the handle, or an external block which constrains the handle in the closed condition.

On the pulling shaft 41 we may see an annular groove 41A on which, in actual use, a central through opening 30A made on membrane 30 is fitted (FIGS. 4, 5), two stroke end flaps 41B, 41C which protrude on opposite sides from a substantially cylindrical stem 41D.

The surface of the annular groove 41A is shaped so as to have a curved upper portion followed by a flat lower portion.

Figure 10A:
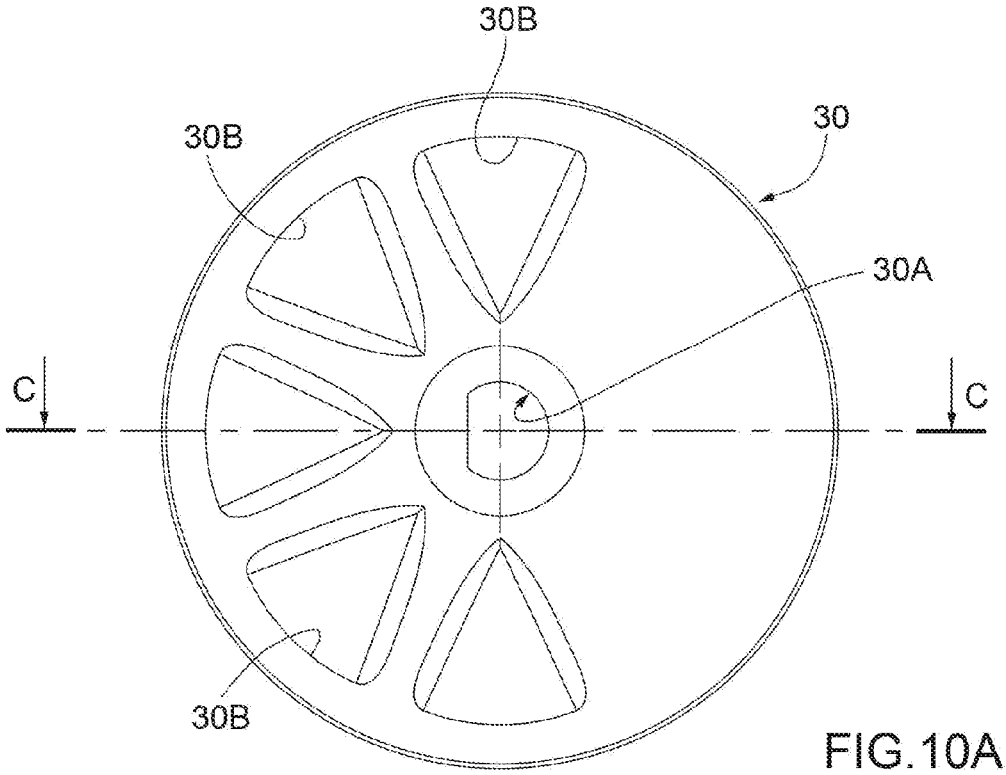
FIGS. 10A and 10B show a bottom view of a membrane used in any aeration apparatus according to the invention and a cross section C-C of the membrane itself, respectively.
Figure 10B:
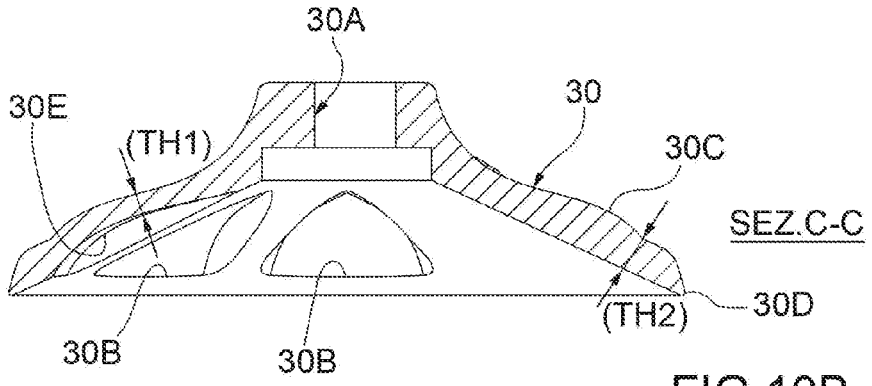

Likewise, the central through opening 30A is provided with a curved upper portion and a flat lower portion (FIGS. 4, 10A, 10B). This is to perform a correct assembly of the pieces (see below).

The upper surfaces of the two stroke end flaps 41B, 41C are curved so as to follow the profile of the inner surface of the inner membrane 30. Two lateral flattened areas 41E, 41F located on opposite sides are made on the surface of stem 41D, of which only one lateral flattened area (i.e. the lateral flattened area 41E) is visible in FIG. 4.

The reasons for which it is preferable to have these two lateral flattened areas 41E, 41F will be explained hereafter. Stem 41D ends with a pin 41G in turn having a curved lower portion, two lateral flattened portions and an upper portion which is also flattened. In other words, the lateral surface of pin 41G is designed so as to be coupled in a satisfactory manner with the surface of the guide seat 20E.

Pin 41G and at least one portion of stem 41D have a blind hole 41H aligned with axis (X).

The blind hole 41H, at least partially, is provided with a threading which can be screwed to the cylindrical front portion 42A of tie rod 42 (see below).

Incidentally, it is useful to note that the through hole (not shown) made on the hopper 101B wall has a larger diameter than the maximum diameter of stem 41D for letting the compressed air pass in the gap which is formed between the through hole and the stem 41D itself (see below).

The radial recesses 30B are arranged only on a portion of the inner surface of membrane 30.

Recesses 30B are mainly arranged in a lower portion of membrane 30.

Preferably, but not necessarily, the radial recesses 30B are located on the entire lower half of membrane 30.

Preferably, but not necessarily, each radial recess 30B is shaped as a "drop" which conveys the air accelerating it, by venturi effect, towards the outside of membrane 30 so as to increase the effectiveness of vibration even at low pressure.

The surface of the outer profile of membrane 30 is smooth with no ribs for facilitating the sliding of the powders.

As shown in FIG. 10B, the outer profile 30C of membrane 30 is shaped as a "wave" in order to have a constant thickness in the section in the vicinity of the radial recess 30B, and a reduction in thickness in the vicinity of edge 30D to increase the effect of vibration of the membrane 30 itself.

In other words, with reference to FIG. 11B, each radial section 30E takes the shape of a venturi, and therefore the pressurized air, distributed radially by means of centrifugal motions, will travel a plurality of venturi-like paths. Therefore, there will be an acceleration of the compressed air in the vicinity of edge 30D, a factor which will increase the frequency of the vibrations of the edge 30D itself with a consequent better distribution of the compressed air in the mass (M) of granular (or powdered) material present in hopper 101B.

The increased kinetic energy of the output compressed air from membrane 30 in its lower part will further promote the penetration of the air itself in the mass (M) of material.

Moreover, since each radial recess 30B has a smaller thickness (TH1) (FIG. 10B) than the minimum thickness (TH2) of the part of membrane 30 without radial recesses 30B, membrane 30 will tend to deform, preferably in its lower portion which results in a lower moment of inertia. For this reason, the compressed air will tend to exit chamber 50 preferably on the side of membrane 30 provided with radial recesses 30B.

In actual use, therefore, by orienting the radial recesses 30B downwards, a strong preferential downward directionality of the air micro-jets exiting the annular gap between the inner surface of the hopper 101B wall and edge 30D of membrane 30 is obtained.

As said above, these micro-jets of compressed air directed preferably downwards will generate a consistent thrust directed on the mass (M) of (granular or powdered) material which is located at a given time in hopper 101B, thus preventing the formation of bridges, voids, etc., all factors which would delay, even considerably, the discharge of the product from the discharge port 101C.

The assembly of the aeration apparatus 10 on the hopper 101B wall is carried out as follows:

(a) the central through opening 30A of membrane 30 is manually fitted on the annular groove 41A on the pulling shaft 41, so as to obtain the coupling of membrane 30 to the pulling shaft 41 itself (FIG. 5); the particular shape (curved at the top and flat at the bottom) of the surface of the two elements 30A, 41A to be coupled ensures a correct coupling of the two pieces (see below);

(b) then, the pulling shaft 41 is inserted into the through hole made on the hopper 101B wall, obviously so that membrane 30 remains inside the hopper 101B itself; the stroke end flaps 41B, 41C are also now inside hopper 101B on the side of membrane 30;

(c) tie rod 42 is inserted into the through hole 20D provided on bottom 20C of cup 20A;

(d) the threaded cylindrical front portion 42A of tie rod 42 is screwed in the blind hole 41H (of axis (X)) made on the pulling shaft 41; the assembly of tie rod 42 with the pulling shaft 41 is thus obtained;

(e) while performing the screwing referred to in the previous item (d), the operator gradually approaches all the hollow main body 20 to the outer surface of the hopper 101B wall;

(f) the screwing operation ends when:

(f1) the shaped pin 41G enters the guide seat 20E;

(f2) bushing 44 is resting on the outer surface of bottom 20E; and (f3) the circular open edge 20B is resting on the outer surface of the hopper 101B wall.

Figure 5A:
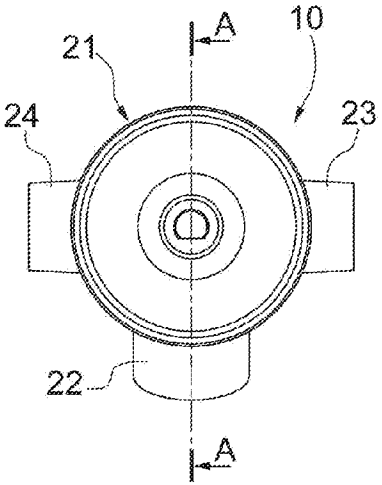
FIGS. 5A, 5B show a front view of the first embodiment shown in FIG. 3, and a longitudinal section A-A (exploded view) of the same, respectively.
Figure 5B:
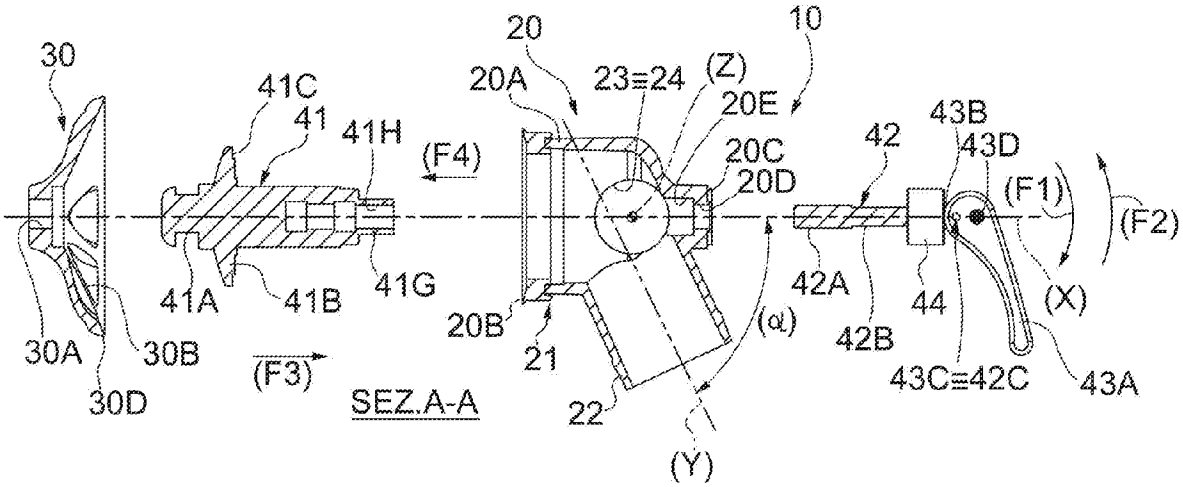
Figure 6:
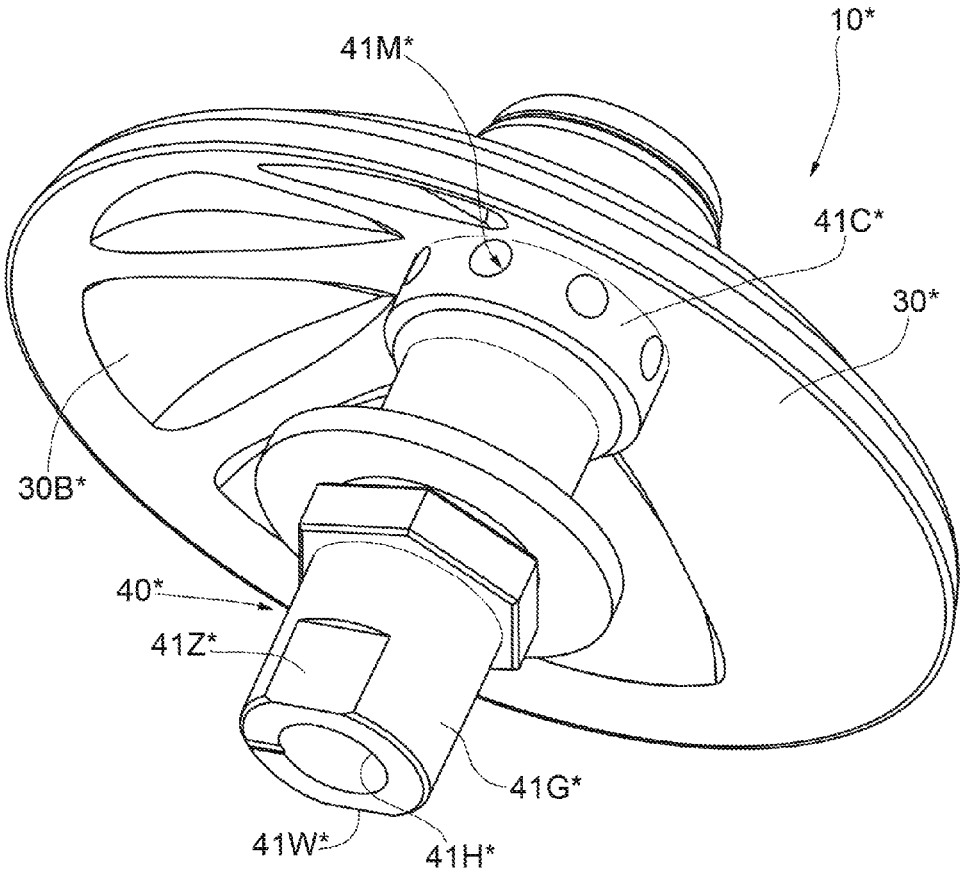
FIG. 6 shows a three-dimensional assembly of a second embodiment of an aeration apparatus according to the invention.
Figure 7:
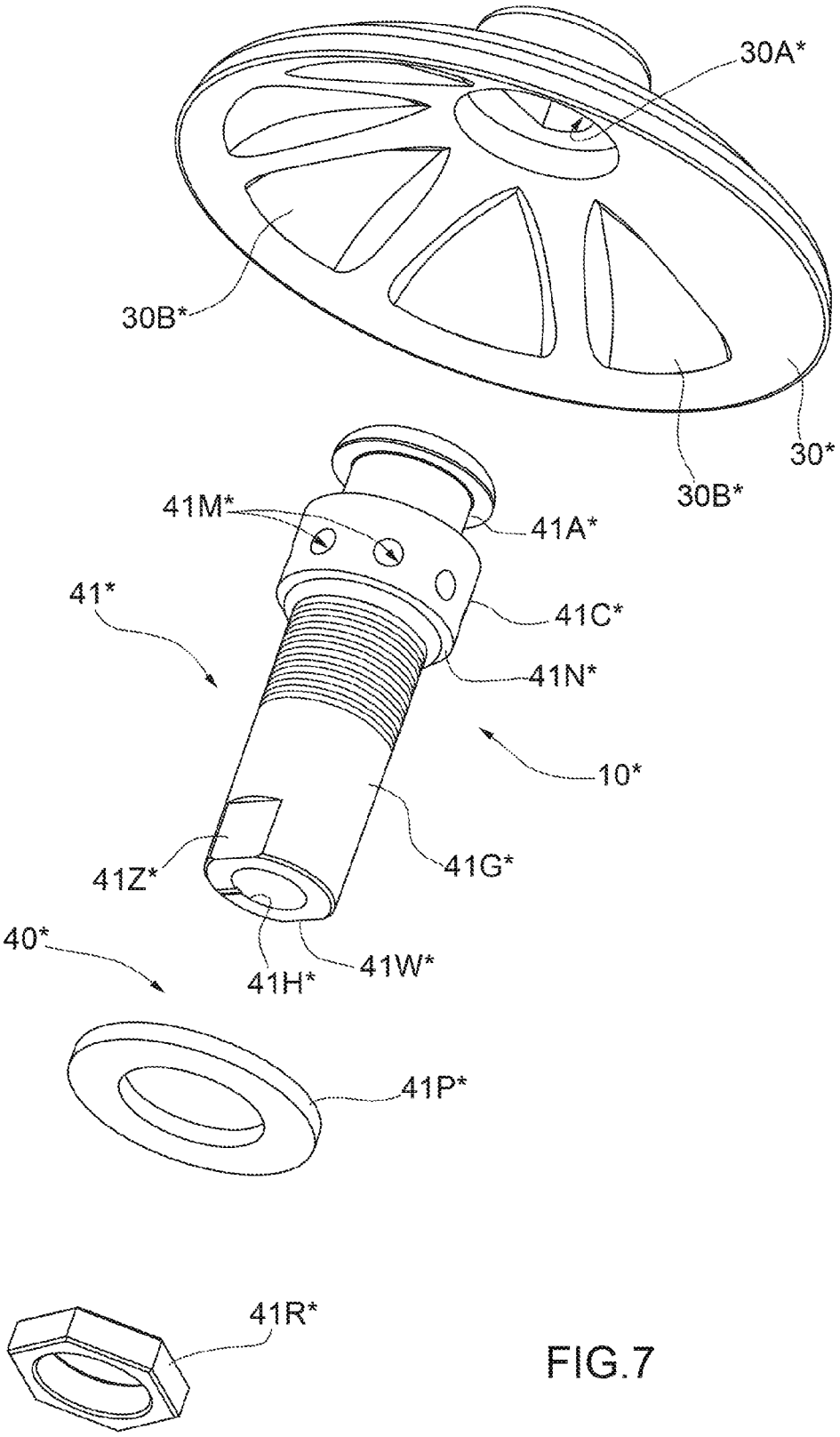
FIG. 7 shows an exploded view of the second embodiment shown in FIG. 6.
Figure 8A:
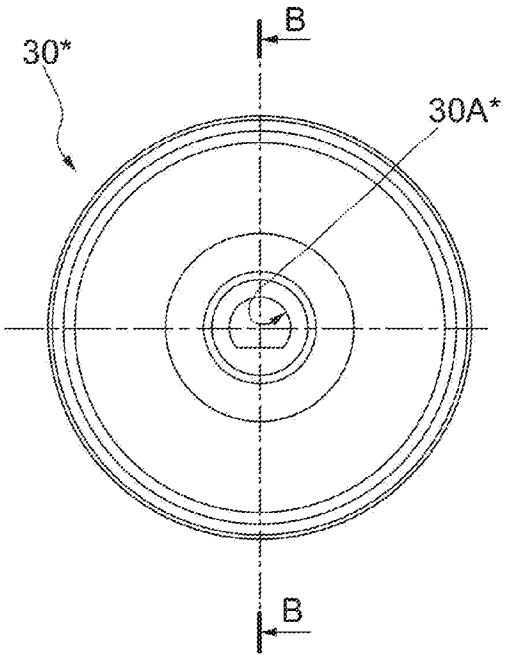
FIGS. 8A, 8B show a front view of the second embodiment shown in FIG. 7, and a longitudinal section B-B (exploded view) of the same, respectively.
Figure 8B:
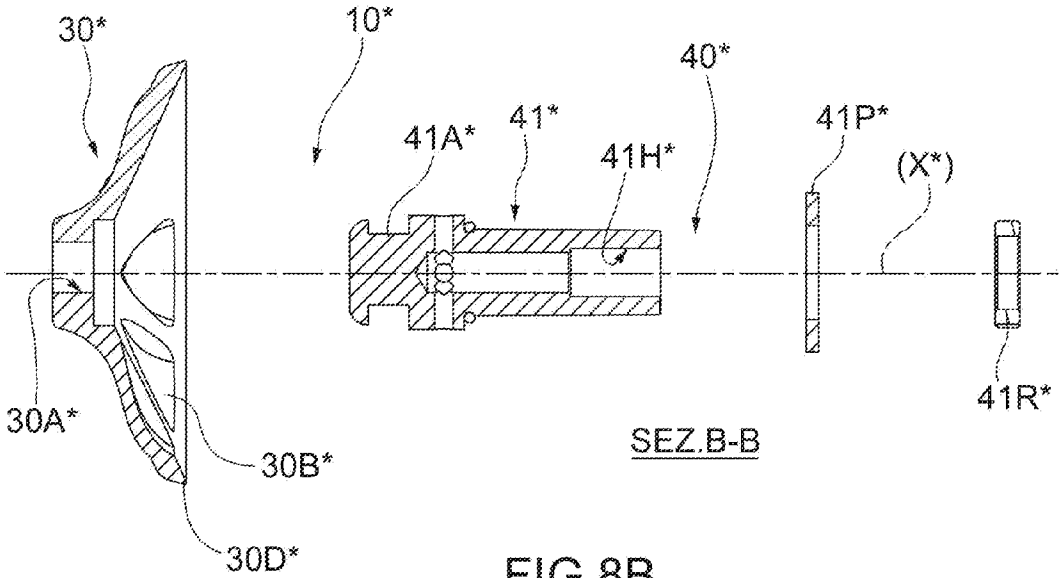

Now the operator can rotate handle 43A according to (F1) (FIG. 5B) so that the pulling action performed by all the pulling and fastening device 40 on membrane 30 takes place according to an arrow (F3) (FIG. 5B). Since bushing 44, as said, is sliding on the cylindrical back portion 42B of tie rod 42, the action carried out on such a bushing 44 by cam 43B results in a thrust (according to an arrow (F4), opposite to the direction indicated by arrow (F3)—FIG. 5B) on the hollow main body 20 which will thus adhere more to the outer surface of hopper 101B. In other words, while membrane 30 is pressed with an increasing force on the inner surface of hopper 101B (arrow (F3); FIG. 6B), the open edge 20B of cup 20A will be increasingly pushed on the outer wall of the hopper 101B itself (arrow (F4); FIG. 5B).

The hopper 101B wall will then be "closed as a clamp" between membrane 30, on one side (i.e. on the side of the inner wall of hopper 101B), and the open edge 20B of cup 20A, on the other (i.e. on the side of the outer wall of hopper 101B).

It will then be possible to send compressed air to the aeration apparatus 10 by means of the distribution network 102 (FIG. 1).

In more detail, we can say that the compressed air, after entering the hollow main body 20 through the supply fitting 22 will flow in the gap specially left free between the through hole made on the hopper 101B wall and the outer surface of the pulling shaft 41.

The two lateral flattened areas 41E, 41F (each of which is provided with a respective hollow-shaped discharge) on the pulling shaft 41 make easier the flow of the compressed air to a distribution chamber 50 delimited by the inner surface of membrane 30 and by the inner surface of the hopper 101B wall (see enlargement in FIG. 1).

From this distribution chamber 50, the compressed air is then distributed inside hopper 101B with the fluid dynamic mechanisms described above.

It should also be noted that the shaped couplings between the two pairs of elements 30A, 41A and 41G, 20E are the main cause of a correct downward orientation of the radial recesses 30B. In fact, if due to such shaped couplings membrane 30 is properly positioned with respect to the pulling shaft 41 and, respectively, the pulling shaft 41 is properly positioned with respect to the hollow main body 20, with the supply fitting 22 facing downwards, the operator will always be sure that the radial recesses 30B are also facing downwards and are, therefore, properly oriented with respect to the task they are to perform.

In other words, considering the asymmetry of membrane 30, it is necessary to have forced shape couplings between the pieces in order to allow a correct assembly of the membrane 30 itself, that is, as said, with the radial recesses 30B facing downwards, i.e. towards the discharge port 101C of tank 101 and the discharge valve (S1) (FIG. 1).

FIGS. 6, 7, 8A, 8B, 9 show a second embodiment of the present invention advantageously applicable to a hopper 101B* (FIG. 9) of a silo (not shown entirely).

Figure 9:
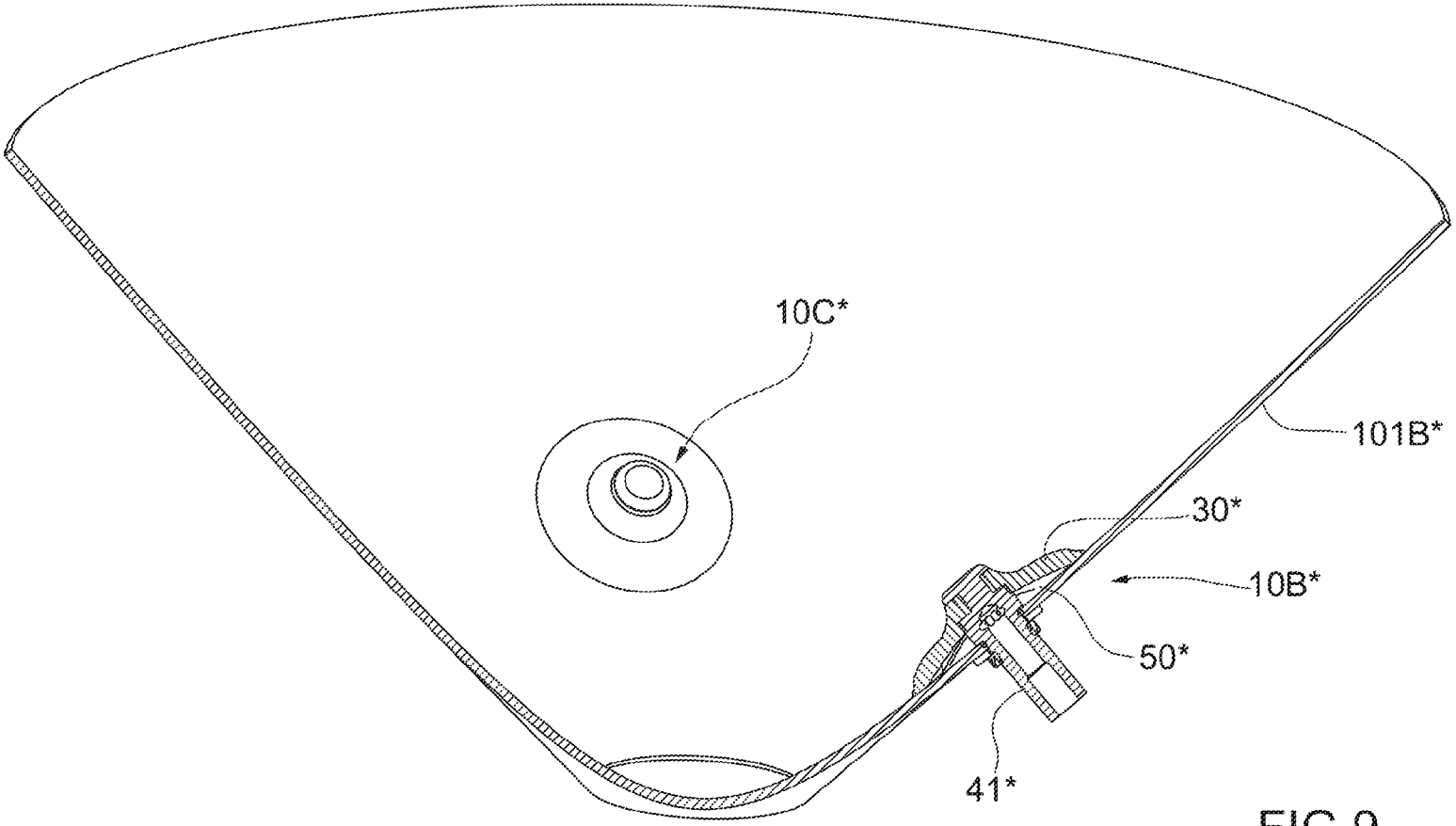
FIG. 9 shows the application of the aeration apparatus shown in FIGS. 6, 7, 8A, 8B to a container, such as a silo.

In the particular embodiment shown in FIG. 9, three aeration apparatuses are mounted on hopper 101B*. However, only two aeration apparatuses 10B* and 10C* are visible in FIG. 9 since hopper 101B* is shown in section.

Since also in this case the three aeration apparatuses are identical, describing a generic aeration apparatus 10* will suffice to describe them all.

As shown in greater detail in FIGS. 6, 7, 8A, 8B, the aeration equipment 10* includes a membrane 30* having an edge 30D*, identical to membrane 30 described above with reference to the first embodiment, and a pulling and fastening device 40* comprising a pulling shaft 41*.

Such a pulling shaft 41* is provided with an annular groove 41A* (virtually identical to the annular groove 41A seen for the first embodiment) adapted to receive a central through opening 30A* (virtually identical to the central through opening 30A seen above) formed on membrane 30*.

The pulling shaft 41* is longitudinally crossed by a blind hole 41H* aligned with an axis (X*) of substantial longitudinal symmetry of the pulling shaft 41* itself.

Below the annular groove 41A* a collar 41C* is placed which is provided with a plurality of radial through holes 41M* which put the blind hole 41H* in communication with the outside and in particular, in use, with a chamber 50* (FIG. 9) delimited, as usual, by the inner surface of membrane 30* and by the inner surface of the hopper 101B* wall.

In this second embodiment, the outer surface of a pin 41G*, which is located below collar 41C*, is partially threaded.

Between collar 41C* and pin 41G* there is a shoulder 41N* whose function will be explained hereafter.

The aeration apparatus 10* is provided with a washer 41P*, a threaded nut 41R* and a hollow main body (not shown) similar to that described in relation to the first embodiment.

The assembly of the aeration apparatus 10* on the hopper 101B wall is carried out as follows:

(a) the central through opening 30A* of membrane 30* is manually fitted on the annular groove 41A* on the pulling shaft 41*, so as to obtain the coupling of membrane 30* to the pulling shaft 41* itself; the particular shape (curved at the top and flat at the bottom) of the surface of the two elements 30A*, 41A* to be coupled ensures a correct coupling of the two pieces;

(b) then, the pulling shaft 41* is inserted in the through hole located on the hopper 101B* wall, thus obviously making membrane 30* remain in hopper 101B*; collar 41C* is also located inside hopper 101B* on the side of membrane 30*; in this case, the hole on the hopper wall has virtually the same diameter as pin 41G* and is provided with a sealing gasket (not shown); shoulder 41N* rests on the inner surface of the hopper 101B wall;

(c) on the side of pin 41G* which protrudes outwards of the hopper 101B* wall, washer 41P* and the threaded nut 41R* are inserted;

(d) the threaded nut 41R* is screwed on the threaded part of pin 41G* so that the hopper 101B* wall is clamped on one side by shoulder 41N*, and on the other by the upper surface of washer 41P* pushed by the threaded nut 41R*.

Pin 41G* is then fastened to the hollow main body supplying the compressed air.

Moreover, it should also be noted that the free end of pin 41G* is provided with two lateral flattened areas 41Z*, 41W* located on opposite sides. Such lateral flattened areas 41Z*, 41W* are coupled with a shaped seat (not shown) which is located inside the hollow main body to allow the desired correct orientation downwards of the radial recesses 30B* which are located on the inner surface of membrane 30*.

The aerodynamic operation of membrane 30* is the same as that of membrane 30 of the first embodiment and therefore will not be described again.

The main advantages of the aeration apparatus made according to the teachings of the present invention are as follows:

easy assembly;

reduction in the consumption of compressed air and therefore in the overall energy consumption; and reduction of the container discharge time while ensuring a certain interchangeability with the systems currently on the market.

The invention claimed is:

1. An aeration apparatus to reduce the discharge time for the emptying of a mass (M) of powdered material from any kind of container; the aeration apparatus comprising:

a vibrating membrane coupled to a device for pulling and fastening it to a hopper wall inside of a container, so that said membrane adheres to an inner surface of the hopper wall;

wherein said membrane comprises at least an area of least resistance for an outlet air flow, so that the air comes out from the area of least resistance, and defines a plurality of grooves shaped as radial recesses in a surface of the membrane facing the inner surface of the hopper wall;

wherein the radial recesses are only on a lower portion of the membrane positioned more proximate a discharge port and each is oriented to distribute the outlet air flow radially outward toward an edge of the membrane and downwards toward the discharge port, thereby producing a downward directionality of air micro-jets exiting an annular gap between the inner surface of the hopper wall and the edge of the membrane.

2. The aeration apparatus according to claim 1, characterized in that the outer surface of the membrane is smooth and is wave-shaped in order to get a constant thickness in its section in correspondence to said radial recess, and a reduced thickness in its section in correspondence to the edge of the membrane.

3. The aeration apparatus according to claim 1, characterized in that each radial recess is shaped as a drop.

4. The aeration apparatus according to claim 3, characterized in that each radial section of any radial recess is venturi-shaped.

5. The aeration apparatus according to claim 1, characterized in that said device for pulling and fastening said membrane comprises pulling means and at least one pulling element; said pulling means being threaded and said pulling element comprising at least a threaded nut.

6. The aeration apparatus according to claim 5, characterized in that said pulling means comprise internal ducts for supplying compressed air below said membrane.

7. The aeration apparatus according to claim 1, characterized in that said device for pulling and fastening said membrane comprises pulling means and at least one pulling element able to operate said pulling means.

8. The aeration apparatus according to claim 7, characterized in that said pulling element comprises a cam handle.

9. The aeration apparatus according to claim 8, characterized in that said cam handle rest on a bushing; said bushing freely sliding on a back portion of said pulling means.

10. The aeration apparatus according to claim 8, characterized in that said pulling element comprises locking means that secure the pulling element in a fixed position resistant to vibration.

* * * * *